US006811020B2

(12) United States Patent
Bailey

(10) Patent No.: US 6,811,020 B2
(45) Date of Patent: Nov. 2, 2004

(54) WOOD CHIP FLINGER AND METHOD OF DENSELY PACKING WOOD CHIPS

(75) Inventor: Kenneth F. Bailey, Apex, NC (US)

(73) Assignee: Bailey Consulting, Inc., Apex, NC (US)

( * ) Notice: Subject to any disclaimer, the term of this patent is extended or adjusted under 35 U.S.C. 154(b) by 127 days.

(21) Appl. No.: 10/241,725

(22) Filed: Sep. 11, 2002

(65) Prior Publication Data

US 2004/0045628 A1 Mar. 11, 2004

(51) Int. Cl.[7] ..... B65G 31/04
(52) U.S. Cl. ..... 198/642; 414/301; 414/339
(58) Field of Search ..... 198/642; 414/293, 414/301, 332, 339, 398, 139.4

(56) References Cited

U.S. PATENT DOCUMENTS

| | | | | |
|---|---|---|---|---|
| 627,906 | A * | 6/1899 | Cowles et al. | 198/642 |
| 1,691,683 | A | 11/1928 | Townsend | |
| 2,788,115 | A * | 4/1957 | Friedman | 414/301 |
| 2,845,190 | A | 7/1958 | Creuzburg | |
| 2,970,782 | A | 2/1961 | Fleissner | |
| 3,191,783 | A | 6/1965 | Henderson | |
| 3,643,819 | A | 2/1972 | Halcomb | |
| 4,479,428 | A | 10/1984 | Krueger et al. | |
| 4,820,108 | A | 4/1989 | Kneer | |
| 5,184,714 | A | 2/1993 | Tapp | |
| 5,316,429 | A | 5/1994 | Connelly et al. | |
| 5,348,434 | A | 9/1994 | Peeples et al. | |
| 5,393,189 | A | 2/1995 | Berquist | |
| 5,735,319 | A | 4/1998 | McNamara et al. | |
| 6,213,289 | B1 * | 4/2001 | Hay et al. | 198/642 |
| 2002/0076308 | A1 | 6/2002 | Bailey et al. | |

* cited by examiner

*Primary Examiner*—Joseph Valenza
(74) *Attorney, Agent, or Firm*—Coats & Bennett, P.L.L.C.

(57) ABSTRACT

A wood chip loading device loads wood chips into a container with a density greater than that achieved using conventional free-fall techniques by 20%–35% or more. The wood chip loading device may include a drum rotating about a generally horizontal axis. The drum includes a plurality of outwardly extending blades that act to fling the wood chips out in a truncated sector pattern. The wood chips form a wide-based stack in the container such that the wood chips have a substantially uniform orientation, thereby allowing for greater packing densities. The device may also include a feed chute assembly that allows for adjustment of the ratio of the input stream that is delivered to the middle and side portions of the spinning drum. In some of these embodiments, this adjustment may be made while the device is operating, thereby allowing for on-the-fly adjustments by the operator.

39 Claims, 7 Drawing Sheets

WOOD CHIP FLINGER AND METHOD OF DENSELY PACKING WOOD CHIPS

BACKGROUND OF THE INVENTION

The present invention relates generally to the field of wood chip processing, and more particularly to a machine and associated method for dense loading of containers with wood chips.

One major factor in the cost of wood chips for paper making is the cost of transporting the wood chips from the chip manufacturing site to the paper mill. The wood chips are typically transported in rail cars, but may also be transported in barges, trailers, or the like. Typically, the transportation costs are based primarily on the number of containers used to ship a given load of wood chips. As more densely packed containers means that fewer containers are required to ship a given amount of wood chips, it follows that more densely packed containers will generally supply more useable wood chips to the paper mill at a lower transportation cost.

In view of this cost dynamic, there has been substantial effort over a long period of time to develop dense packing techniques. For instance, several prior art techniques feed wood chips to a distribution element that spins about a vertical axis. Such devices are shown, for instance, in U.S. Pat. No. 5,735,319 to McNamara et al. and in U.S. Patent Application Publication US2002/0076308 to Bailey et al. Such techniques tend to output wood chips in a circular pattern, which is less than ideal for some containers, such as rectangular railcars. Further, such techniques are limited in many situations to an increase in packing density of typically not more than 17% over conventional free-fall Accordingly, there remains a substantial need in the industry for alternate wood chip loading techniques, preferably techniques that produce non-circular output patterns and/or higher packing densities.

SUMMARY OF THE INVENTION

A wood chip loading device of the present invention loads wood chips into a container with a density greater than that achieved using conventional free-fall techniques. Preferably, the device packs the wood chips at a density that is at least 25% more than that achieved with the conventional free-fall techniques. Due to this higher packing density, the cost of shipping the wood chips is significantly reduced.

In one embodiment, the wood chip loading device includes a drum rotating about a generally horizontal axis. The drum includes a plurality of outwardly extending blades that act to fling the wood chips out so as to land in a landing zone that is less than semicircular, and preferably generally in the shape of a truncated sector of 1°–30° in arc, and more preferably in a generally rectangular pattern. The output of such a device may be used to form a stack of wood chips in a transport container such that the wood chips have a substantially uniform orientation therein, thereby allowing for greater packing densities.

Some embodiments of the present invention include a feed chute assembly that allows for adjustment of the ratio of the input stream that is delivered to the middle and side portions of the spinning drum. In some of these embodiments, this adjustment may be made while the device is operating, thereby allowing for "on-the-fly" adjustments by the operator.

DESCRIPTION OF THE PREFERRED EMBODIMENTS

Figure 1:
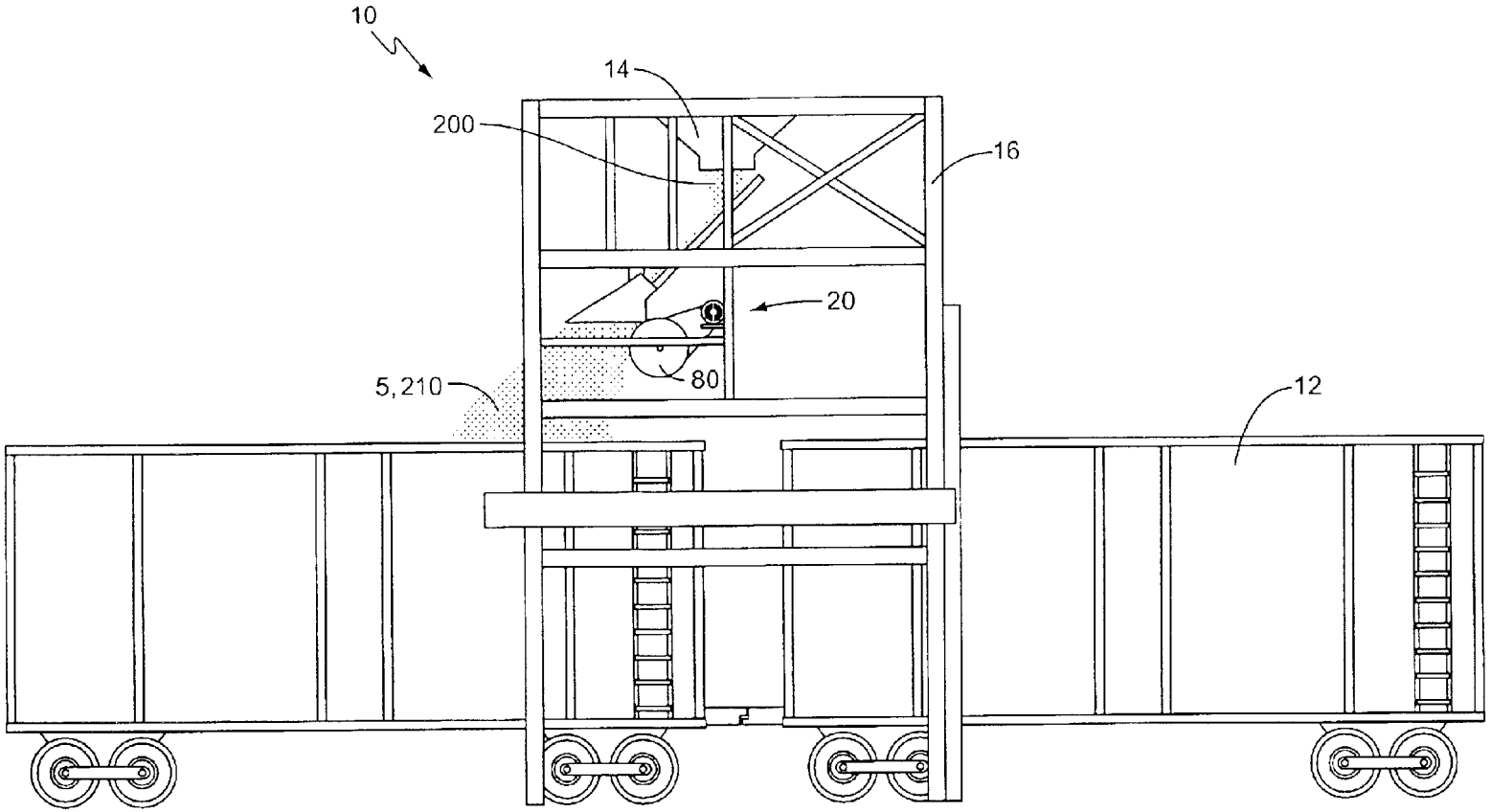
FIG. 1 shows one embodiment of the loading device of the present invention employed in a wood chip loading station 10 for filling railcars.

In order to provide a better understanding of the present invention, one embodiment of the wood chip loading device according to the present invention is shown in FIG. 1 in the context of a wood chip loading station 10 for filling railcars 12. The wood chip loading device, generally indicated at 20, is shown installed in a tower structure 16 that extends above a rail line with a railcar 12 thereon. Wood chips 5 are fed to the loading device 20 in the tower 16 by any suitable means, such as by conventional conveyor system 14 (only the output funnel of which is shown for clarity), or alternatively via a pneumatic means into a cyclone, or by other like means known in the art. The loading device 20 takes the input stream of wood chips from the conveyor 14 and directs it into the railcar 12 so that the wood chips 5 are relatively densely packed in the railcar 12. In most applications, the railcar 12 will be moved underneath the loading device 20 during the loading process so as to fill the entirety of the railcar's length, but the device 20 (with or without the tower 16) may alternatively be moved while the railcar 12 is held stationary, if desired.

One embodiment of the loading device 20, sometimes referred to herein as the "flinger," includes a frame 22, a motor 24, a feed chute assembly 30, and a drum 80. The frame 22 supports the motor 24, feed chute assembly 30, and drum 80, and may take any suitable form known in the art, such as welded assembly of angle iron. The motor 24 supplies rotational power to the drum 80, typically via a pulley and belt arrangement (not shown). The motor 24 may be of any type known in the art, but is typically an electric motor of approximately fifteen horsepower or more.

Figure 6:
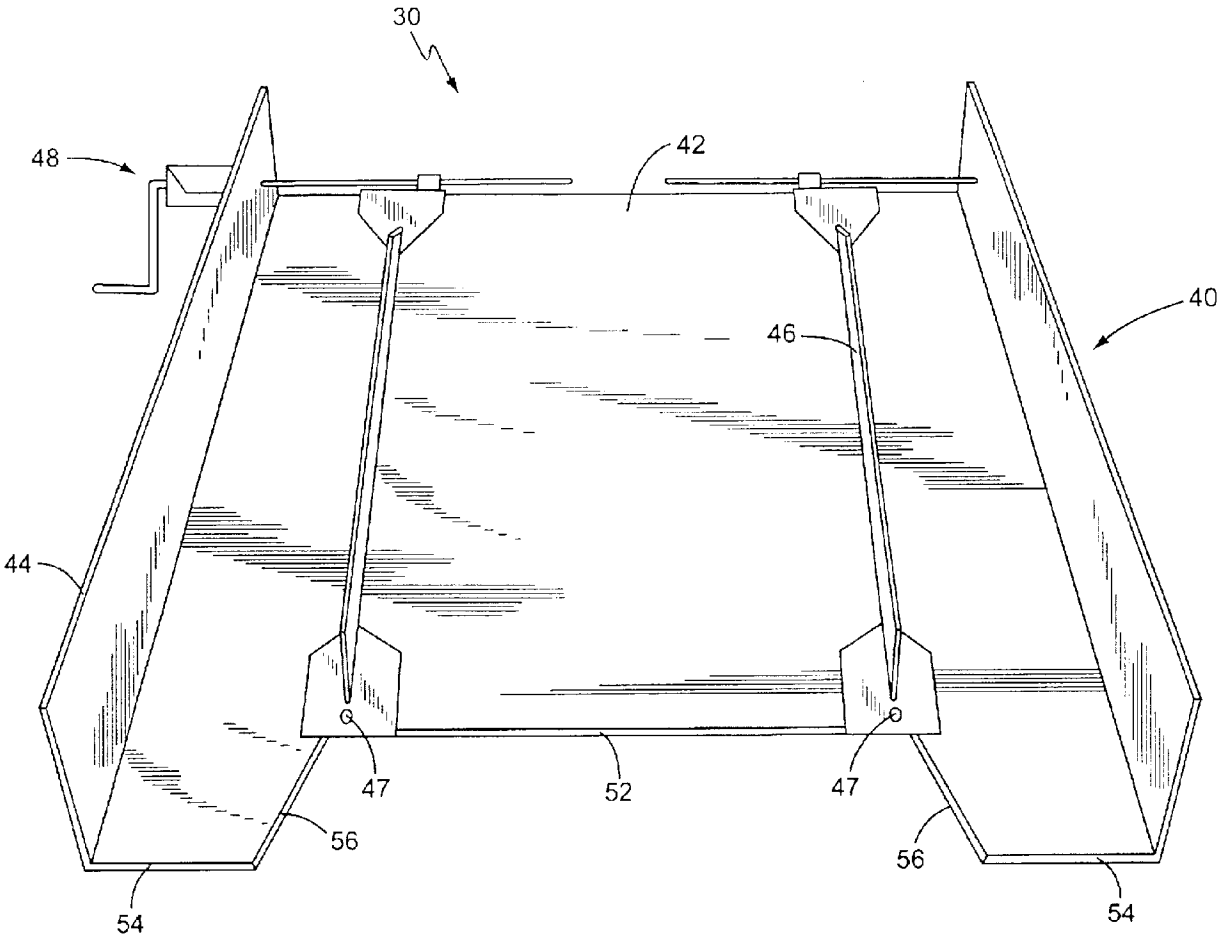
FIG. 6 shows a front perspective view of the baseplate assembly of the embodiment of FIG. 2.

Disposed above the drum 80, and between the drum 80 and the conveyor system 14, is a feed chute assembly 30. Referring to FIG. 6, the feed chute assembly 30 includes a sloped baseplate assembly 40 and an optional deadwall 60 towards the output end 50 thereof. The baseplate assembly 40 of a preferred embodiment includes a baseplate 42 and dividers 46. The baseplate 42 is a sturdy, substantially rectangular plate with side flanges 44. The baseplate 42 is disposed in a tilted orientation, so that the input end is higher than the output end 50. Referring to FIG. 6, the output end 50 preferably has a stepped profile, with a center section 52 flanked by respective side sections 54, and corresponding transition sections 56. The center and side sections 52,54 are preferably straight and parallel to one another, with the center section 52 ending earlier than the side sections 54. The transition sections 56 provide a transition between the center section 52 and the side sections 54. In a preferred embodiment, the overall appearance of the output end 50 of the baseplate 42 is that of a trapezoid cutout as shown in FIG. 6, but this is not required.

Two dividers 46 may be moveably attached to the baseplate 42 so as to be selectively positioned by pivoting about corresponding pivot points 47 (e.g., shouldered bolts extending through the baseplate 42). The location of the upper ends of the dividers 46 may be adjusted with respect to the baseplate 42 using a suitable adjusting mechanism 48. By way of non-limiting example, the adjusting mechanism 48 may take the form of a crank and threaded rod arrangement, with suitable pivoting connections between the tops of the dividers 46 and the threaded rods. Of course, other means known in the art may be used to control the position of the upper ends of the dividers 46. Whatever means is selected, it will be advantageous to position the controls thereof (e.g., the crank) so as to allow easy access thereto by a user during operation of the loading device 20. The purpose of the dividers 46 is to control the flow ratio of the wood chips flowing down the baseplate assembly 40 to the center 82 and side portions 84 of drum 80.

Figure 2:
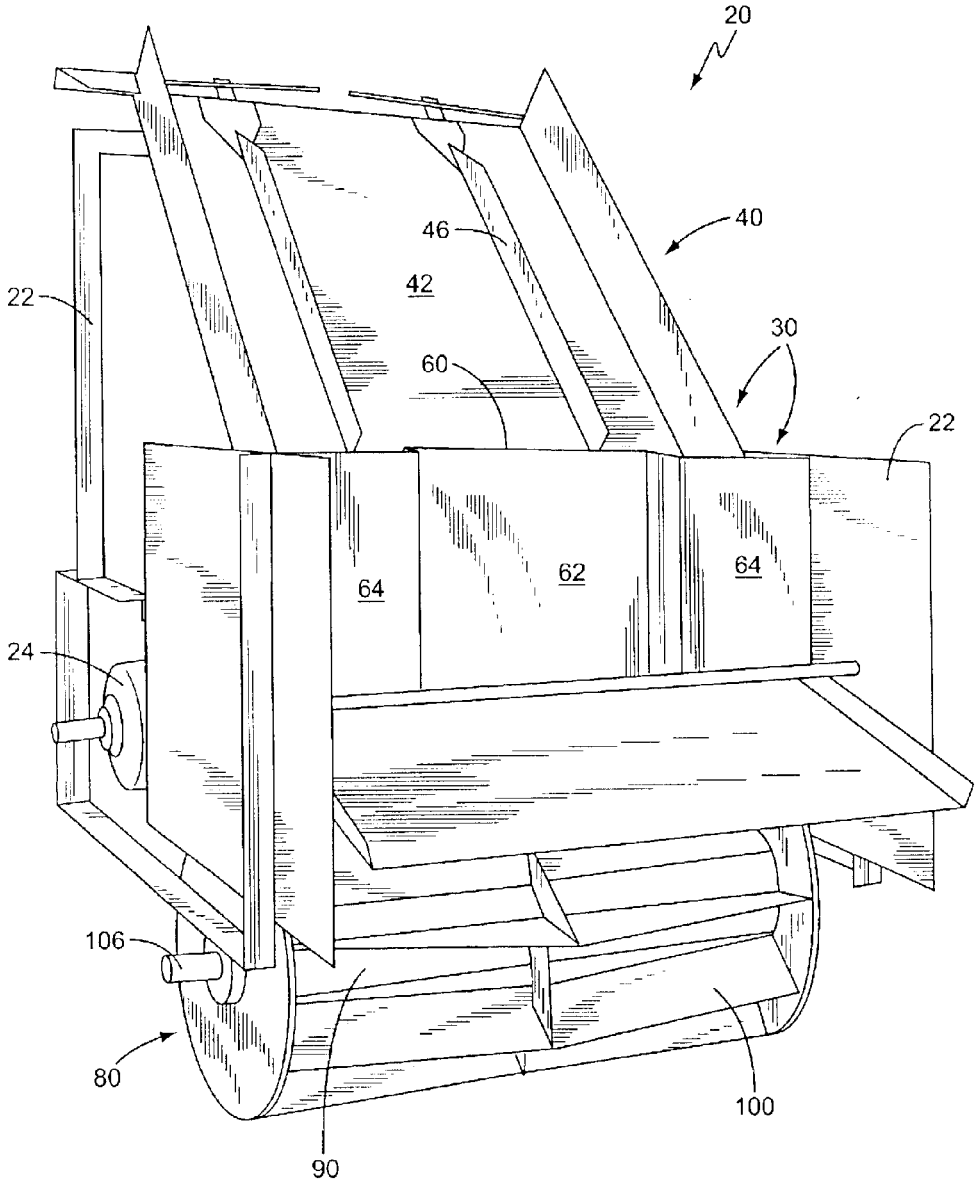
FIG. 2 shows a perspective view of one embodiment of loading device of the present invention.
Figure 4:
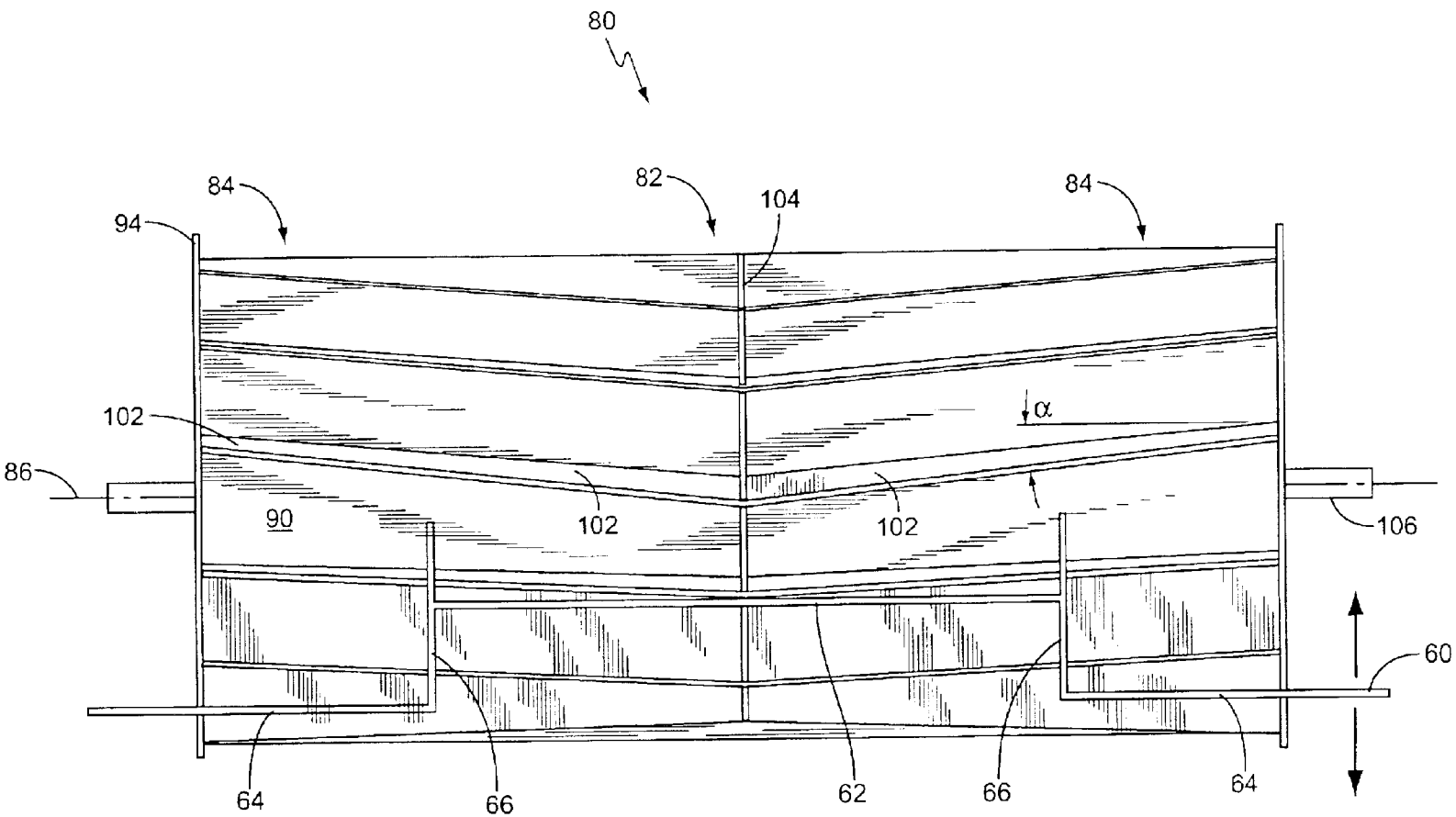
FIG. 4 shows a simplified top view of the drum and deadwall of FIG. 2, with the optionally extended offset sections on the deadwall.

The deadwall, or directing wall, 60 is a generally vertical wall that acts to focus the flow of the wood chips flowing down the baseplate assembly 40 generally vertically onto the drum 80. As shown in FIG. 2 and FIG. 4, the deadwall 60 may include a center section 62, flanking side sections 64, and appropriate offset sections 66 therebetween. The center and side sections 62,64 are preferably straight and parallel to one another, and preferably are disposed a height from the center of drum 80. The offset sections 66 are preferably generally perpendicular to the center and side sections 62,64 and are likewise disposed at the same height from drum 80. Thus, the deadwall 60, when viewed from above, preferably has the shape shown in FIG. 4. Further, the deadwall 60 should be located, and be of sufficient height, so that the wood chips from the baseplate 42 impact in the vertical middle of the deadwall 60. It should be noted that the offset sections 66 may simply connect the center and side sections 62,64; or, alternatively, the offset sections 66 may be longer such that they extend to a point well beyond the intersection with the center section 62, such as having approximately twice the length as shown in FIG. 4. This optional "extra" length for the offset sections 66 is believed to aid in achieving the desired side-to-side balance of wood chips being supplied to the drum 80.

Figure 3A:
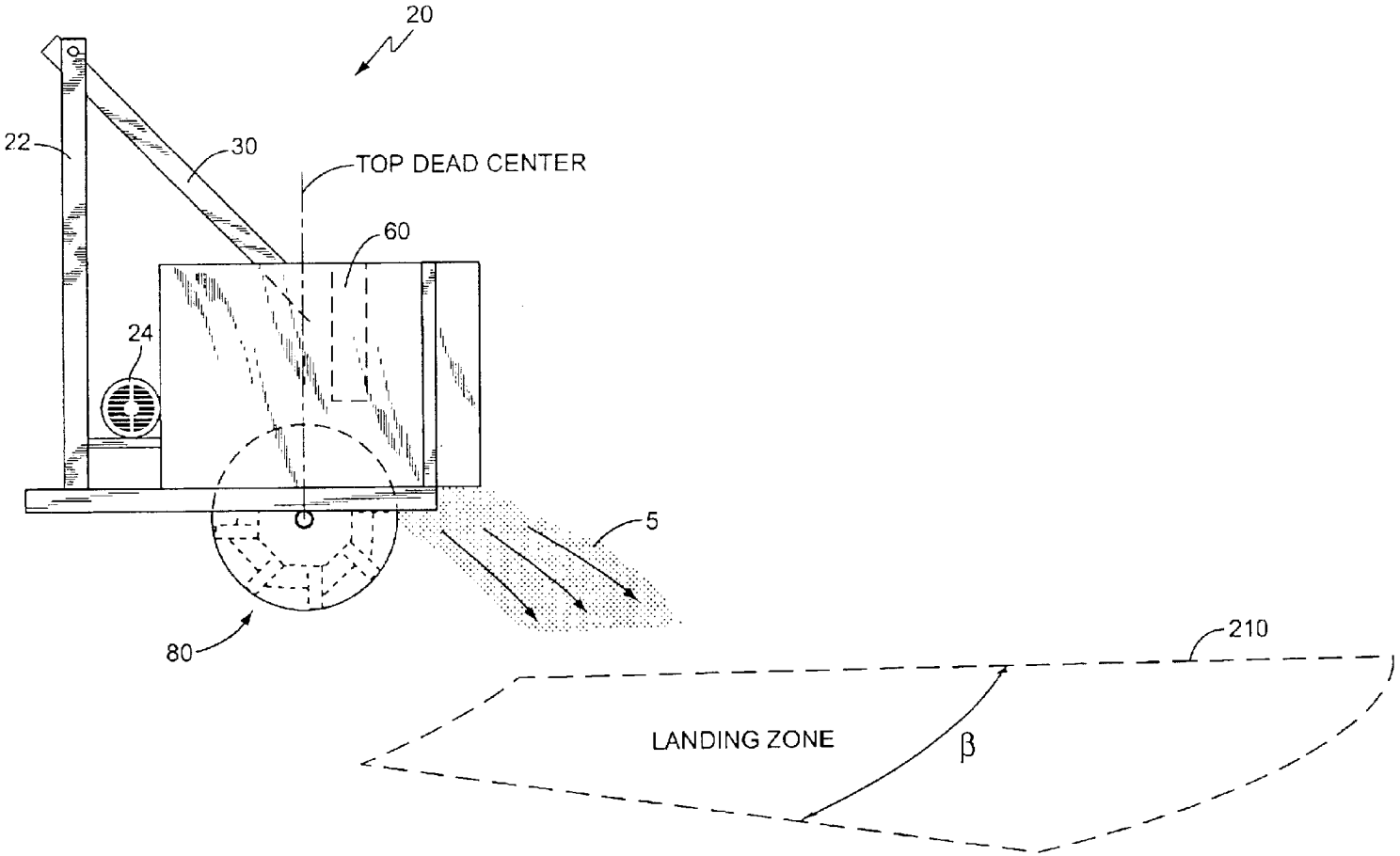
FIG. 3A shows a side view of the embodiment of FIG. 2.
Figure 3B:
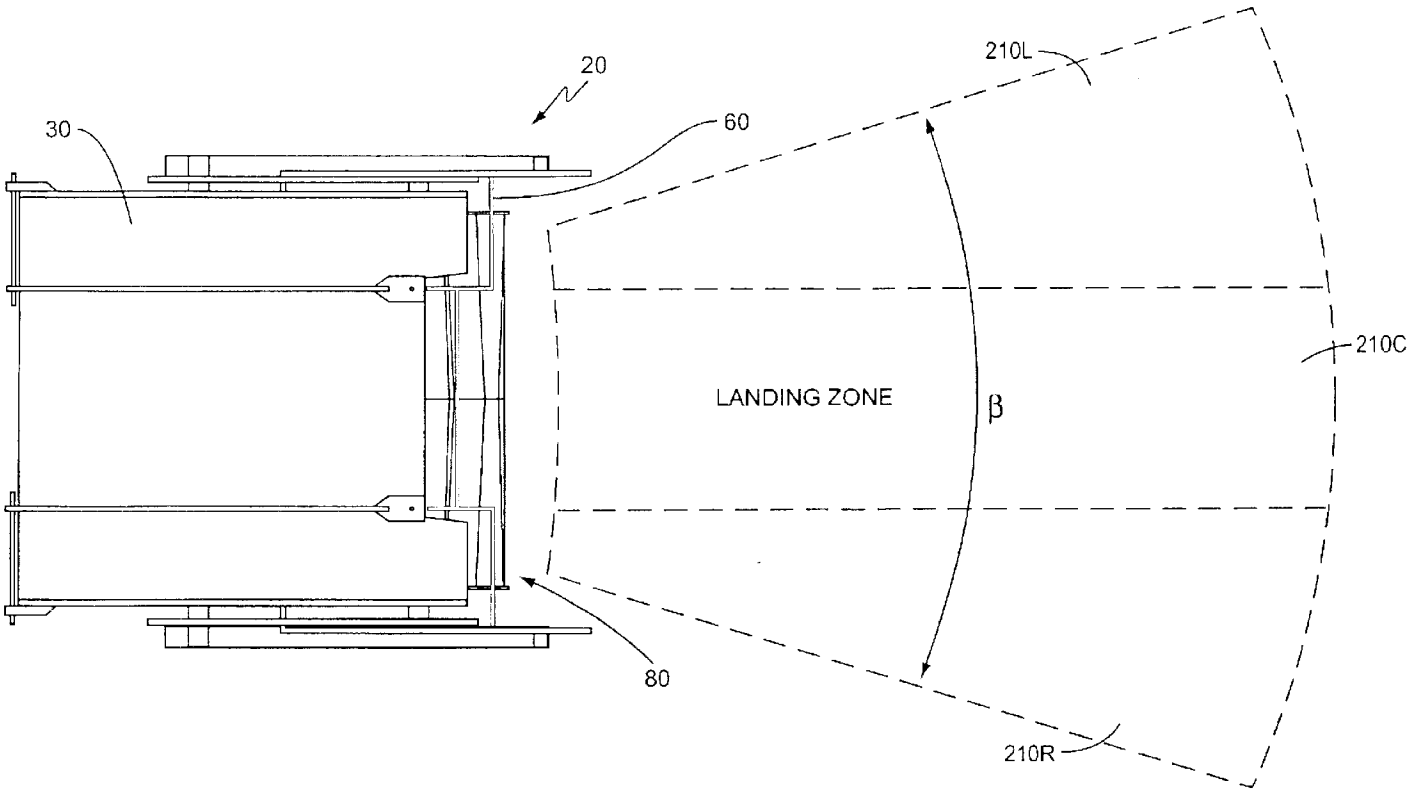
FIG. 3B shows a top view of the embodiment of FIG. 2, with the optionally extended offset sections on the deadwall.

The deadwall 60 is located forward of the output end 50 of the baseplate assembly 40, so that a substantial gap is formed therebetween to allow passage of the wood chips without jamming as the wood chips change flow direction. Further, while the deadwall 60 may be located prior to top dead center (behind the rotation axis 86 of the drum 80), the deadwall is advantageously located at a position that is beyond top dead center of the drum 80 (see FIGS. 3A and 3B). For the optimum gap to be formed, the center section 62 of the deadwall 60 should be narrower than the center section 52 of baseplate 42 by about an inch, with the transition sections 56 of the baseplate 42 extending laterally approximately another two inches. Of course, the gap size is at least partially governed by the spacing between the output end of the baseplate assembly 40 and the location of the deadwall 60. The position of the deadwall 60 relative to the baseplate 42 and/or drum 80 may be permanently fixed; however, the position of the deadwall 60 may be adjustable (for instance, ±3 inches) in some embodiments of the present invention, such as by mounting the deadwall 60 using bolts, with multiple bolt holes provided in the frame 22. It may be advantageous to vary the gap size, nominally eight inches, in proportion to the desired output rate of the device 20.

While the space above the baseplate 42 of the feed chute assembly 30 may be open, the feed chute assembly 30 may optionally include a cover (not shown) spaced from the baseplate 42 to help contain any errant wood chips. The optional cover may extend above the top of the deadwall 60, and be spaced therefrom, so as to provide an overflow route, if desired.

Figure 5:
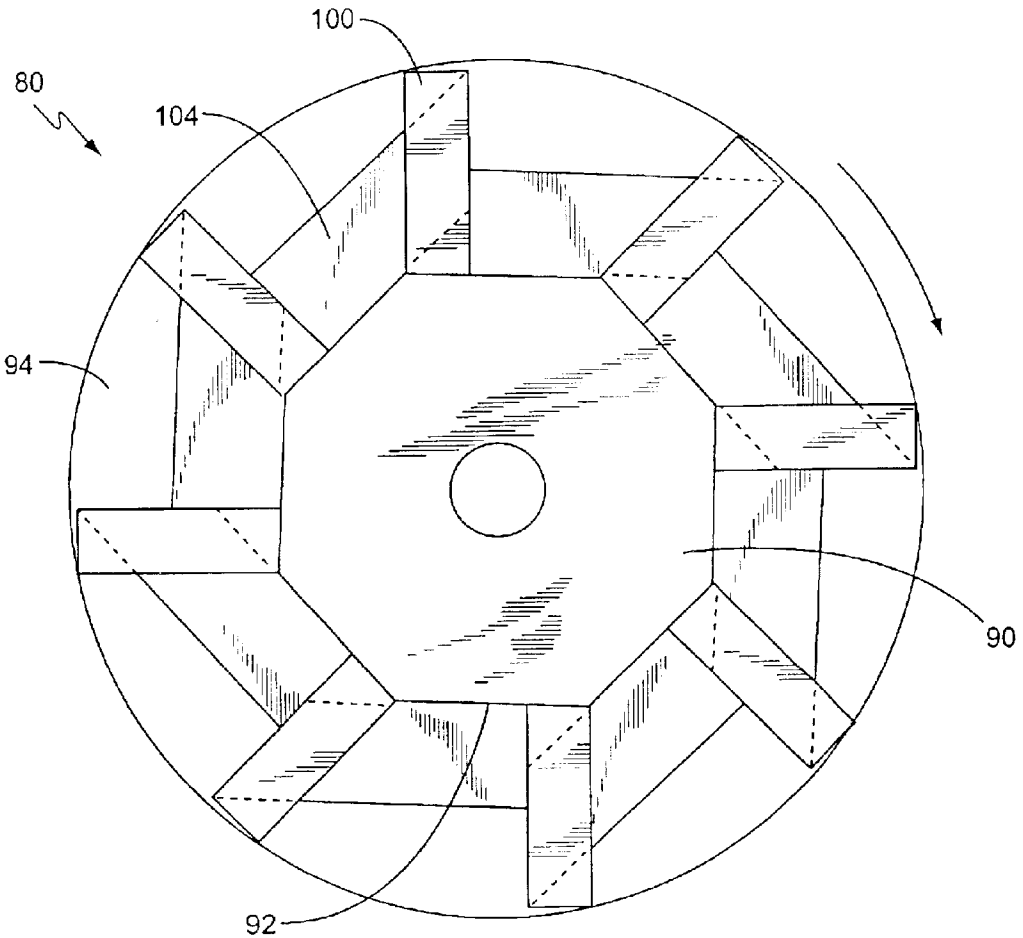
FIG. 5 shows a side view of the drum of FIG. 4 with the near endcap removed.

The drum 80 is mounted for rotation about a generally horizontal axis 86, and supported by the frame 22. The drum 80 may be mounted to an axle 106, which may be a central shaft or a pair of stub shafts, which is in turn supported by suitable bearings mounted to the frame 22. As indicated above, the axle 106 should have a pulley, gear, or like means for accepting non-gravitational rotational power to turn the drum 80, such as from motor 24. The drum 80 includes a main body core 90 with a plurality of outwardly extending blades 100, and preferably a pair of lateral endcaps 94. The main body 90 of the drum 80 may have a circular cross-section, but preferably has a faceted cross-section, such as an octagonal cross-section as shown in FIG. 5. The blades 100 are mounted to the core 90 so as to extend away from the surface thereof; for instance, the blades 100 may extend generally perpendicular from the corresponding facet 92 forming the perimeter of the drum 80. The blades 100 should preferably extend from one lateral endcap 94 to the other. Each blade 100 may be a single straight piece, disposed parallel to the axis of rotation 86 or at an angle thereto, for instance alternating ±30°, or preferably ±10°. Alternatively, each blade 100 may advantageously include at least two sections 102 that angled with respect to one another at angle $\alpha$. For instance, as shown in FIG. 4, each blade 100 may have left and right portions 102 that meet in the center of the core 90 and are angled with respect to one another 1°–30°, preferably about 3°–10°. When this arrangement is viewed from above, each facet 92 of the drum's core 90 appears to have a chevron shaped blade 100 thereon (see FIG. 4). Each blade 100 preferably has an approximately uniform height across its width, and the blades 100 are preferably substantially identical, but neither aspect is strictly required for all embodiments. A reinforcing gusset 104 may extend circumferentially from one blade 100 to the next blade 100.

The loading device 20 may be used to load wood chips, and particularly uniformly-sized paper making wood chips, into a suitable container. The device 20 is mounted to the tower 16 of the loading station 10. A container, such as a railcar 12, is positioned below and forward of the loading device 20, and motor 24 is started to start the drum 80 rotating. Before feeding wood chips to the device 20, the drum 80 should be rotating at a rate of at least approximately 50 rpm, more particularly at least about 200 rpm, and more particularly at approximately 350 rpm. When the drum 80 is spinning properly, wood chips are supplied to the feed chute assembly 30 by the conveyor system 14. The wood chips slide down the baseplate 42, between the dividers 46, hit against the deadwall 60, and then fall as an input stream 200 to the drum 80. The output end 50 of the baseplate 42, the deadwall 60, and the dividers 46 collectively control the relative proportions wood chips being fed to the center 82 and side portions 84 of the drum 80. The wood chips fall to the drum 80 and are then flung forward by the blades 100 of the spinning drum 80. The wood chips flung from the drum 80 are captured by the container 12. Due to the interaction of the feed chute assembly 30 and the drum 80 spinning on a generally horizontal axis 86, the output pattern 210 of the wood chips leaving the drum 80 is such that the vast majority of the wood chips would (if unconstrained by the container) land forward of the device 20 and within in an area that angularly sweeps less than 180°. This output pattern 210 may be conceptually described as a truncated sector that sweeps angle $\beta$, where $\beta$ is less than 180°. Indeed, $\beta$ is preferably less than 45°, and more preferably less than about 20°. Further it should be noted that while the term "sector" has been used, the strict geometrical definition is not meant, as the boundaries of the pattern 210 do not need to be arc shaped. Indeed, when β is very small, such as about 10°, the output pattern may be described as substantially rectangular. Thus, defining the output pattern 210 as a truncated sector means that the output pattern where substantially all of the wood chips leaving the device 20 would fall, if not deflected by intervening surfaces (such as walls of the container 12), forms any shape that does not fall outside a 180° angular sweep from the middle of the drum 80. Thus, the truncated sector output pattern 210 is intended to include, without limitation, the pattern shown in FIGS. 3A & 3B, and similar substantially rectangular patterns.

Even with a truncated sector output pattern 210, there may be an undesirable side-to-side distribution of the wood chips within the output pattern 210. For instance, the distribution of wood chips in the output pattern 210 to the middle subsector 210C, right side subsector 210R, and left side subsector 210L may be uneven and/or otherwise undesirable for some reason (e.g., output shifted left of center, leaving right side subsector 201R relatively unfilled). If the optional variably positioned dividers 46 are employed, then the ratio of output flow to the various subsectors 210C,210R,210L may be adjusted by the operator during operation (via adjusting mechanism 48) to reach the desired ratios. Of course, adjustments can also be made to the drum 80 rotational speed and to the wood chip supply rate from the conveyor system 14.

While the exact principles are not fully understood, the loading device 20 of the present invention is able to pack wood chips within the containers 12 at density substantially higher than so-called free-fall loading. In free-fall loading, the wood chips from the conveyor system 14 are directed to the container via a simple chute system. Examination of free-fall loaded wood chips "packed" in a container show that they land with widely varying orientations, sometime referred to as "jack strawed" (like unstacked firewood), resulting in non-optimum density. In contrast, the wood chips loaded via the present device 20 land with a substantially consistent orientation, resulting in increased density.

The actual packed density achieved is expected to vary depending on variations in size and moisture content of the wood chips. However, a simple ratio, referred to herein as the packing density factor, can be used to quantify the improvement provided by the present invention. The packing density factor is simply the ratio of the weight of wood chips in a given container when loaded with the test device 20 divided by to the weight of the same volume of the same type wood chips (i.e., same size and moisture content), loaded using the free-fall method. For instance, it is expected that a common 7100 $ft^3$ railcar 12 loaded with wood chips using the free fall method will have approximately seventy-seven tons of wood chips. It is expected that if the same type wood chips are loaded using the device 20 of the present invention, the 7100 $ft^3$ railcar 12 would hold approximately one hundred tons of wood chips. Using these values, the packing density factor for the present invention would be 100/77=1.30. Clearly, substantial improvements in packing may be achieved using the present device 20, with resulting packing density factors in the range of 1.20 to 1.35 or higher. Just for reference, these type of packing density factors typically correspond to densities of 26.0 pounds/$ft^3$ to 29.3 pounds/$ft^3$ or more.

One example of the loading device 20 of the present invention may be made using a drum 80 with a diameter of approximately 18 inches, approximately 48 inches in width, and an octagonal cross-section of approximately 7 inch wide facets 92. The blades 100 may be approximately 6 inches in height, with two sections of approximately 24⅛ inches meeting at an angle α of approximately 8°, and spaced at intervals of approximately 7 inches. The gussets 104 may be approximately 3 inches in height. The baseplate 42 of the feed chute assembly 30 may be at a 45° angle, with the 24–30 inch high deadwall 60 positioned such that the center section 62 is approximately 5 inches after top dead center and the side sections 64 are approximately 10 inches after top dead center, for a gap of approximately 8 inches. The pivoting divider walls 46 may be made adjustable, with a target distribution of 25%–50%–25% for feeding to the left 84, center 82, and right 84 portions of the drum 80 respectively. All portions of the device 20 contacting the wood chips may advantageously be made from ¼ inch abrasion resistant (AR) steel. The output pattern 210 of such a device should correspond to that shown in FIGS. 3A & 3B with β approximately equal to 8°–10°.

It should be noted that in order to minimize the escape of errant wood chips during loading, the frame 22 may advantageously include additional scatter shields at appropriate locations. The shield locations generally include on either side of the feed chute assembly 30, and slightly downstream from the drum 80, but these locations may vary depending on the details of a particular installation site.

The increase in packing density readily achieved by the present invention has clear benefits to the industry. In the simplest terms, more wood chips can be shipped using fewer containers, thereby lowering transportation costs. Further, given the substantial increase in packing density achieved, the cost savings can be considerable. In addition, by loading railcars 12 to their weight capacity at a higher density, it is possible using the present invention to keep the top of the wood chips below the top of the railcar 12, particularly during non-summer periods, thereby improving the environment by lessening the likelihood that wood chips will blow from the railcar during transit.

Separately, the resulting truncated sector output pattern 210 when using preferred embodiments of the present invention is particularly suited to the filling of rectangular containers, such as railcars 12. Prior art devices which rely on a distribution device that spins about a generally vertical axis tend to create round output patterns covering substantially a full 360°, which are ill suited to filling rectangular containers. As the majority of wood chips shipped between domestic locations are shipped by rail, using rectangular railcars 12, the preferred embodiments of the present invention are more suited to the needs of the industry.

The discussion above has shown the device 20 having an output that is forward and downward, which is believed to be advantageous for most applications. However, by moving the input stream of wood chips relative to the drum 80, from after top dead center to before top dead center, it is believed that the output may be changed to forward and upward, with the wood chips leaving such at device 20 having a slightly "lofted" trajectory. However, the resulting output pattern 210 should still remain a truncated sector (e.g., generally rectangular), not circular.

The discussion above has described a device 20 using a single rotating drum 80. In most applications, this will be sufficient. However, the present invention is not limited thereto, and devices 20 employing a plurality of drums 80 rotating about one or more generally horizontal axes 86 are intended to be encompassed by the present invention. The most likely arrangement for such a multiple drum 80 arrangement would be to have the drums 80 located coaxially, in a manner easily understood by one of ordinary skill in the art based on the teachings of the present application.

While the invention has been illustrated and described in detail in the drawings and foregoing description, the same is to be considered as illustrative and not restrictive in character, it being understood that only some embodiments have been shown and described and that all changes and modifications that come within the meaning and equivalency range of the appended claims are intended to be embraced therein.

What is claimed is:

1. An assembly for loading chip-shaped material, comprising:

a drum disposed so as to rotate about a generally horizontal axis, said drum including a plurality of outwardly extending blades disposed at a non-parallel angle to said axis;

a source of the chip-shaped material that feeds an input stream of the chip-shaped material to said drum above said axis;

said drum throwing said chin-shaped material to form a stacked output.

2. The assembly of claim 1 wherein said source comprises a feed chute disposed upstream from said drum and supplying said input stream of chip-shaped material to said drum.

3. The assembly of claim 2 wherein said feed chute supplies the chip-shaped material to said drum at a location beyond a top dead center location of said drum.

4. The assembly of claim 1 further comprising a container for holding said stacked output of the chip-shaped material.

5. The assembly of claim 1 wherein each of said blades comprise at least first and second sections that are disposed in an angled configuration with respect to each other.

6. The assembly of claim 1 wherein said drum has a core with a plurality of outwardly facing faces disposed between said axis and a radially outermost surface of the blades.

7. The assembly of claim 6 wherein said drum core has a faceted cross-section.

8. The assembly of claim 7 wherein said drum core has an octagonal cross-section.

9. The assembly of claim 1 further comprising a motor operatively connected to said drum and supplying rotational power thereto, and a frame supporting said motor and said drum.

10. The assembly of claim 1 wherein said drum is spinning at 150 rpm or more.

11. The assembly of claim 10 wherein said drum is spinning at 300 rpm or more.

12. The assembly of claim 2 wherein said feed chute comprises a baseplate and a plurality of divider walls moveably mounted to said baseplate, wherein said divider walls control the relative flow ratios of said input stream to a first side portion, a center portion, and a second side portion of said drum.

13. The assembly of claim 12 wherein said feed chute further comprises a generally vertical directing wall disposed towards an output end of said feed chute, said directing wall having a central section and at least one side section, said central section of said directing wall disposed more upstream with respect to a rotational direction of said drum than said side section of said directing wall.

14. The assembly of claim 13 wherein said baseplate has a lower endface proximate said directing wall, said endface having a center section, first and second wing sections on opposing side of said endface center section, and first and second transition sections between said endface center section and said first and second wing sections, respectively; said endface center section and said wing sections being substantially parallel, and said transition sections being angled with respect to said endface center section.

15. The assembly of claim 14 wherein said center section of said endface of said baseplate is generally aligned with, but longer than, said central section of said directing wall.

16. The assembly of claim 1 wherein output from said drum forms a truncated sector pattern when said input steam of chip-shaped material is fed to said drum.

17. The assembly of claim 1 wherein said stacked output has a density greater than a free fall density.

18. The assembly of claim 1 further comprising a motor operatively connected to said drum and supplying rotational power thereto.

19. The assembly of claim 1 further comprising a motor operatively connected to said drum and supplying rotational power thereto:

wherein said source comprises a feed chute disposed upstream from said drum and supplying said input stream of chip-shaped material to said drum;

said feed chute comprises a baseplate and a plurality of divider walls moveably mounted to said baseplate, wherein said divider walls control the relative flow ratios of said input stream to a first side portion, a center portion, and a second side portion of said drum;

wherein said feed chute further comprises a generally vertical directing wall disposed towards an output end of said feed chute, said directing wall having a central section and at least one side section, said central section of said directing wall spaced with respect to a rotational direction of said drum from said side section of said directing wall.

20. The assembly of claim 19 wherein said chip-shaped material are paper making wood chips and wherein said stacked output has a density of at least 26.6 pounds/ft$^3$.

21. An assembly for loading chip-shaped material in a container, comprising:

a drum rotating about a generally horizontal axis, said drum including a plurality of outwardly extending blades;

wherein said blades are disposed to cause chip-shaped material leaving said assembly to be flung a distance so as to be collected within the container with a density greater than a free fall density;

wherein said blades are disposed at a non-parallel angle with respect to said axis.

22. The assembly of claim 21 wherein said drum has a core with a plurality of outwardly facing faces disposed between said axis and a radially outermost surface of the blades.

23. The assembly of claim 21 further comprising a feed chute disposed upstream from said drum and supplying an input stream of chip-shaped material to said drum.

24. The assembly of claim 23 wherein said feed chute supplies the chip-shaped material to said drum at a location above said rotational axis.

25. The assembly of claim 23 wherein said feed chute comprises a baseplate and a plurality of divider walls moveably mounted to said baseplate, wherein said divider walls control the relative flow ratios of said input stream to a first side portion, a center portion, and a second side portion of said drum.

26. An assembly for loading chip-shaped material in a container, comprising:

a drum rotating about a generally horizontal axis, said drum including a plurality of outwardly extending blades;

wherein said blades are disposed to cause the chip-shaped material leaving said assembly to be flung a distance so as to be collected within the container with a density greater than a free fall density;

a feed chute disposed upstream from said drum and supplying an input stream of the chip-shaped material to said drum; said feed chute comprising a baseplate and a plurality of divider walls moveably mounted to said baseplate; and wherein said feed chute further comprises a generally vertical directing wall disposed towards an output end of said feed chute, said directing wall having a central section and at least one side section, said central section of said directing wall disposed more upstream with respect to a rotational direction of said drum than said side section of said directing wall.

27. The assembly of claim 26 wherein said baseplate has a lower endface proximate said directing wall, said endface having a center section, first and second wing sections on opposing side of said endface center section, and first and second transition sections between said endface center section and said first and second wing sections, respectively; said endface center section and said wing sections being substantially parallel, and said transition sections being angled with respect to said endface center section.

28. The assembly of claim 21 wherein, when an input steam of chip-shaped material is fed to said drum when said drum is spinning at a rate of at least approximately 50 rpm, output from said drum forms a truncated sector pattern.

29. An assembly for loading chip-shaped material in a container, comprising:

a drum rotating about a generally horizontal axis, said drum including a plurality of outwardly extending blades;

wherein said blades are disposed to cause the chip-shaped material leaving said assembly to be flung a distance so as to be collected within the container with a density greater than a free fall density; and a feed chute disposed upstream from said drum and supplying an input stream of the chip-shaped material to said drum, wherein said blades are disposed at a non-parallel angle with respect to said axis.

30. The assembly of claim 21 further comprising a feed chute disposed upstream from said drum and supplying an input stream of chip-shaped material to said drum, and further comprising a motor operatively connected to said drum and supplying rotational power thereto, wherein said feed chute comprises a baseplate and a plurality of divider walls moveably mounted to said baseplate, wherein said divider walls control the relative flow ratios of said input stream to a first side portion, a center portion, and a second side portion of said drum.

31. An assembly for organizing chip-shaped material in a densely packed manner, comprising:

a drum disposed so as to rotate about a generally horizontal axis and spinning at a rate of about 50 rpm or more, said drum including a plurality of outwardly extending blades;

said blades disposed at a non-parallel angle to said axis;

a motor operatively connected to said drum and supplying rotational power thereto;

a feed chute disposed upstream from said drum and supplying an input stream of the chip-shaped material to said drum; and wherein said blades of said spinning drum act on said input stream to generate an output stream of the chip-shaped material leaving said assembly to be flung a distance and form a stack of chip-shaped material, the chip-shaped material in said stack non-randomly oriented so as to be stacked with a density greater than a free fall density.

32. The assembly of claim 31 wherein said output stream from said drum forms a truncated sector pattern when said input steam of wood chips is fed to said drum across the full width thereof.

33. The assembly of claim 32 further comprising a container for holding said stack of chip-shaped material.

34. A method for organizing chip-shaped material in a densely packed manner, comprising:

rotating a drum at a rate of about 50 rpm or more about a generally horizontal axis, said drum including a plurality of outwardly extending blades, said blades disposed at a non-parallel angle to said axis;

supplying rotational power to said drum via a motor;

feeding an input stream of chip-shaped material to said drum via a feed chute disposed upstream from said drum;

flinging the chip-shaped material a distance from said assembly by said blades acting on said input stream;

forming an output stack of the chip-shaped material flung from said assembly, the chip-shaped material in said output stack non-randomly oriented so as to be stacked with a density greater than a free fail density.

35. The method of claim 34 wherein said flinging comprising flinging said chip-shaped material from said assembly in a manner so as to form a truncated sector output pattern.

36. The method of claim 34 wherein said forming said output stack comprises forming said output stack in a container.

37. The assembly of claim 26 wherein said blades and said directing wall are angled relative to one another.

38. The assembly of claim 37 wherein said directing wall is disposed generally parallel to said axis and wherein said blades are disposed at a non-parallel angle with respect to said axis.

39. An assembly for organizing chip-shaped material, comprising:

a drum rotating about a generally horizontal axis, said drum including a plurality of outwardly extending blades;

wherein said blades are disposed to cause the chip-shaped material leaving said assembly to be flung a distance so as to form a stack with a density greater than a free fall density;

a feed chute disposed upstream from said drum and supplying an input stream of the chip-shaped material to said drum; said feed chute comprising a baseplate and a plurality of divider walls moveably mounted to said baseplate; and wherein said feed chute further comprises a generally vertical directing wall disposed towards an output end of said feed chute, said directing wall having a central section and at least one side section, said central section of said directing wall disposed more upstream with respect to a rotational direction of said drum than said side section of said directing wall.

* * * * *